US008418857B2

(12) United States Patent
Razzaboni et al.

(10) Patent No.: US 8,418,857 B2
(45) Date of Patent: Apr. 16, 2013

(54) DEVICE AND METHOD FOR STORING AND DISPENSING BANKNOTES

(75) Inventors: Vittorio Razzaboni, Mirandola MO (IT); Nicoletta Razzaboni, Mirandola MO (IT)

(73) Assignee: Cima S.p.A. di Razzaboni & C., Mirandola MO (IT)

( * ) Notice: Subject to any disclaimer, the term of this patent is extended or adjusted under 35 U.S.C. 154(b) by 466 days.

(21) Appl. No.: 12/224,338

(22) PCT Filed: Mar. 2, 2007

(86) PCT No.: PCT/EP2007/001809

§ 371 (c)(1),
(2), (4) Date: Feb. 11, 2009

(87) PCT Pub. No.: WO2007/101621

PCT Pub. Date: Sep. 13, 2007

(65) Prior Publication Data

US 2009/0301946 A1 Dec. 10, 2009

(30) Foreign Application Priority Data

Mar. 7, 2006 (IT) ..... MI2006A0407

(51) Int. Cl.
*B07C 5/00* (2006.01)

(52) U.S. Cl.
USPC ..... 209/534; 194/206

(58) Field of Classification Search ..... 209/534; 194/206, 207; 700/223, 228, 229
See application file for complete search history.

(56) References Cited

U.S. PATENT DOCUMENTS

| | | | | |
|---|---|---|---|---|
| 4,972,958 | A * | 11/1990 | Ito et al. | 209/534 |
| 5,000,322 | A * | 3/1991 | Goi | 209/534 |
| 5,186,334 | A * | 2/1993 | Fukudome et al. | 209/534 |
| 5,478,992 | A * | 12/1995 | Hamada et al. | 235/379 |
| 6,889,850 | B2 * | 5/2005 | Amari et al. | 209/534 |
| 7,225,911 | B2 * | 6/2007 | Yokoi et al. | 194/205 |
| 7,461,747 | B2 * | 12/2008 | Razzaboni et al. | 209/534 |
| 2004/0149817 | A1 | 8/2004 | Kuroiwa et al. | |
| 2005/0056519 | A1 * | 3/2005 | Yokoi et al. | 194/206 |
| 2008/0061127 | A1 * | 3/2008 | Brexel | 235/379 |
| 2010/0032352 | A1 * | 2/2010 | Ozaki et al. | 209/534 |

FOREIGN PATENT DOCUMENTS

| | | |
|---|---|---|
| EP | 0 881 605 | 5/1998 |
| EP | 1291 831 | 4/2002 |
| WO | WO 2006/063555 | 6/2006 |

OTHER PUBLICATIONS

International Search Report dated May 8, 2007.

* cited by examiner

*Primary Examiner* — Joseph C Rodriguez
(74) *Attorney, Agent, or Firm* — Jacobson Holman PLLC

(57) ABSTRACT

An automatic device for storing and dispensing banknotes of a preset number of denominations including an inlet for the banknotes, recognition device for recognizing the denomination of the incoming banknotes, a plurality of LIFO roller magazines for storing the banknotes, an outlet for the banknotes, conveyors for conveying the banknotes between the inlet, the magazines and the outlet. A controller suitable for controlling the conveyors for transferring the banknotes from the inlet to the magazines during the depositing step and transferring the banknotes from the magazines to the outlet during the dispensing step. The magazines are smaller in number than a preset number of banknote denominations. The controller includes storage devices for storing the sequence of denominations stored in each magazine and a processor for controlling the conveyors to transfer the banknotes from one magazine to the other in function of the stored sequences and a dispensing request entered in the device, to enable the banknotes to be dispensed from the magazines to the outlet according to the request.

8 Claims, 1 Drawing Sheet

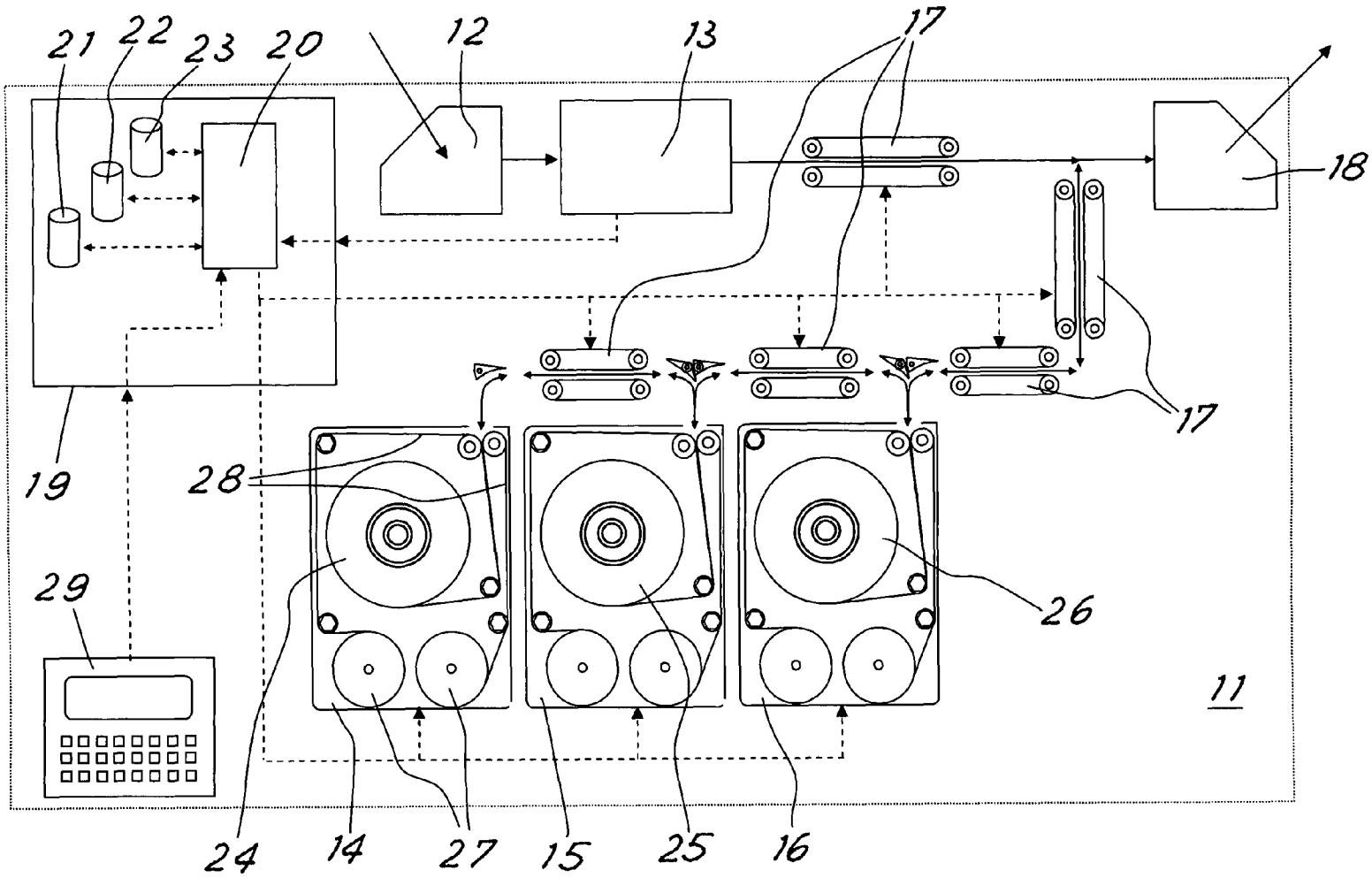
11
12
13
14
15
16
17
17
18
19
20
21
22
23
24
25
26
27
28
29

DEVICE AND METHOD FOR STORING AND DISPENSING BANKNOTES

This is a national stage of PCT/EP2007/001809 filed Mar. 2, 2007 and published in English.

The present invention relates to an innovative device for storing and dispensing banknotes. The invention also refers to a method for storing and dispensing banknotes using this device.

Automatic devices have been known for some time in the prior art that are intended for storing and dispensing banknotes, for example at a bank or similar institutes.

A type of device that is very widespread in the industry uses a plurality of roller magazines. Around each roller a pair of strips of film is wound between which the banknotes to be stored are interposed. Rollers are also known that use a single plastic film.

These magazines operate with a LIFO logic, i.e. the last banknotes to enter the magazine are the first to exit the magazine at the moment of dispensing.

In known machines there is a roller magazine for each denomination of banknotes to be handled. For example, if the machine is intended to handle euros, the device has to comprise at least seven roller magazines, one for each denomination of banknote.

The presence of such a great number of roller magazines makes the machines particularly costly, due to the considerable number of mechanical components required for the operation thereof.

Further, the device is very cumbersome, having to contain the seven storage drums of the different denominations. Specially in the case of small banks, the available space is a critical resource, so that the cumbersome prior-art devices have proved to be inadequate and unsatisfactory.

The general object of the present invention is to overcome the aforementioned drawbacks by providing a device for storing and dispensing banknotes that is cheap, has a simple structure and is not cumbersome.

In view of this object, it was decided to devise, according to the invention, an automatic device for storing and dispensing banknotes of a preset number of denominations comprising an inlet for the banknotes, recognition means for recognizing the denomination of the incoming banknotes, a plurality of LIFO magazines for storing the banknotes, an outlet for the banknotes, conveying means for conveying the banknotes between the inlet, the magazines and the outlet, control means suitable for controlling the conveying means for transferring the banknotes from the inlet to the magazines during the depositing step and transferring the banknotes from the magazines to the outlet during the dispensing step, characterized in that the magazines are smaller in number than said preset number of banknote denominations, the control means comprising means for storing the sequence of denominations stored in each magazine and means for controlling the conveying means to transfer the banknotes from one magazine to the other in function of the stored sequences and a dispensing request entered in the device, to enable the banknotes to be dispensed from the magazines to the outlet according to the request.

Still according to the invention it was decided to devise a method for storing and dispensing banknotes of a preset number of denominations using a device comprising an inlet for the banknotes, recognition means for recognizing the denomination of the incoming banknotes, a plurality of LIFO magazines for storing the banknotes, an outlet for the banknotes, conveying means for conveying the banknotes between the inlet, the magazines and the outlet, control means suitable for controlling said conveying means, the magazines being smaller in number than the preset number of banknote denominations and the control means comprising means for storing the sequence of denominations stored in each magazine, the method comprising for storing the steps of:

- recognizing the denomination of each incoming banknote through the recognition means,
- establishing the destination magazine for the incoming banknote in function of the sequences of denominations stored through control means,
- updating the datum relating to the sequence of denominations in the magazine chosen as the destination of the incoming banknote and storing the banknote in said magazine, and for dispensing the steps of:

- receiving from a user terminal a request to dispense banknotes,
- calculating if the requested banknotes are not available at the outlet of the magazines, transferred between the magazines for releasing at each transfer one or more banknotes to be dispensed in function of the stored sequences of the denominations in the magazines and the dispensing request,
- performing the calculated transfers by dispensing after each transfer one or more banknotes from the magazines to the outlet and updating at each dispensing the data relating to the sequences of denominations stored in the magazines.

In order to make the explanation of the innovative principles of the present invention and the advantages thereof over the prior art clearer, with the help of the attached drawing a possible embodiment will be described below by way of an example applying these principles.

FIG. 1 is a schematic view of the mechanical components and of the control means of a banknote storage and dispensing device 11 made according to the invention. The device 11, for example, can be intended for handling seven different denominations of banknotes, as in the case of euros.

The device comprises an inlet 12 suitable for receiving a wad of banknotes to be stored by the operator of the machine.

A known recognizing device 13 is provided as standard for the inlet 12 that is suitable for receiving in sequence the banknotes coming from the inlet 12 to detect the denomination of the banknotes.

The device 11 also comprises a plurality of roller magazines 14, 15, 16, intended to store the incoming banknotes entering the machine.

According to the invention, the number of the magazines is smaller than the number of banknote denominations intended to be handled by the device 11. This solution enables the cost of the mechanical components of the machine to be reduced, in addition to also noticeably reducing the total encumbrance thereof.

The magazines could be from two to five. In a preferred embodiment of the invention, there are three magazines and they are identical to one another.

The magazine 14 comprises a roller 24 on which in use a pair of strips of film 28 are wound. Between the strips of film 28, according to known solutions, the stored banknotes are interposed on the roller, which acts as an LIFO logic (last in first out). The strips 28 are unwound from reels 27. The roller magazine is made according to well-known prior-art techniques and will not therefore be disclosed further.

The machine also comprises conveying means 17 (shown schematically in the FIGURE) that is suitable for conveying the banknotes from the inlet to the magazines during the storage step and from the magazines to the outlet 18 during the dispensing step. As will be shown below, during the banknotes dispensing step the conveying means 17 can also be used to transfer the banknotes from a magazine to the other so as to free the banknotes on the drums that have to be issued.

The conveying means 17 is per se made with components (pulleys, belts, deviators, etc.) that are well known in the field of banknote storage and dispensing devices. They form a path from the inlet to the outlet to which the magazines are connected in a derived manner. The representation in FIG. 1 is given by way of example; other configurations of the path are possible, as is clear to those skilled in the art.

The various components of the conveying means 17 are controlled electronically through the control means 19 of the device in the ways that are described below.

During the money-depositing step, a wad of banknotes is positioned by the operator of the device at the inlet 12. The inlet block 12 leafs through the wad of banknotes and aligns them to be able to supply them to the following recognition block 13 in the correct position.

At the recognition block each banknote is examined in such a way as to detect the denomination thereof and possibly whether it is false.

The recognizing device 13 transmits the datum on the denomination of the banknote to the control means 19.

The control means 19 comprises a processor 20 that is made with any prior-art electronic device suitable for the purpose, and storage means 21-23 suitable for storing a sequence of denominations of the banknotes stored on each of the rollers 24-26 of the magazines 14-16. Each memory 21, 22, 23 stores the sequence of one of the magazines 14-16.

During the depositing step the processor 20 receives the datum on the denomination of the incoming banknote and establishes the destination magazine of the banknote in function of the denomination thereof and of the sequences stored in the memories 21-23.

The control means 20 uses a routing algorithm for the banknotes that may be of different types.

It could be used to make a subsequent dispensing process as rapid as possible, for example by distributing as evenly as possible the different denominations on the drums so as to have various denominations available near the end of the sequences of banknotes on the drums.

Once the destination magazine for the incoming banknote has been calculated, the controller 20 sends control signals to the different components that form the conveying means 17 for the banknotes, in such a way as to guide the banknote from the recognition block 13 to the selected destination magazine.

Once the destination magazine of an incoming banknote has been calculated, the datum is updated on the sequence of denominations stored in the memory 21-23 that corresponds to the destination magazine of the banknote.

During the dispensing step, following a banknote emission request entered by the operator through a user terminal 29, the processor 20 calculates in function of the data memorized in the memories 21-23 the transfers of banknotes from a magazine to the other that are necessary for being able to dispense from the outlet 18 the banknotes matching the request entered by the operator.

In fact, the banknotes are stored at random on the drums of the magazines 14-16, so that in most cases banknotes will be required that are not available immediately to the outlet of the LIFO magazines.

It is therefore necessary, knowing the positions for the banknotes on the drums from the memory means 21-23, to free the banknotes required by transferring from a magazine to the other the banknotes preceding the one to be dispensed in the magazines.

The processor 20 calculates a series of transfers of banknotes to be made between the magazines using a search algorithm that processes the data on the sequences of the denominations and the requested dispensing datum. Following each transfer one or more banknotes are dispensed and the data on the sequences are memorized that are stored in the memories 21-23.

It is often required for the required banknotes to be dispensed continuously inside a denomination, i.e. with first all the banknotes of a denomination, then with those of a subsequent denomination and so on. A similar dispensing specification is considered in the formulation of the search algorithm of the banknotes.

The algorithms used may be of different types. They can be advantageously structured in such a way as to minimize the dispensing time of the required sum. The nature of the algorithms may vary according to various factors (for example the calculation power of the processor, the capacity of the magazines, the arrangement of the magazines and the transfer speed between them, etc.).

The simplest algorithms could calculate a transfer from a magazine to another, checking each time the magazine that provides greater dispensing speed of each single banknote, i.e. the one that has the requested banknote nearest to the outlet.

More sophisticated algorithms could conduct a calculation of the shifts that takes account of the total dispensing time of several banknotes in sequence.

For each good count, once the transfer between magazines has been calculated, the controller 19 controls the conveying means 17 and the magazines in such a way as to perform the transfer, after which the requested banknote is sent to the outlet 18.

A further "storage" magazine could be provided, in addition to the three main magazines. The additional magazine can be used to prepare dispensing of very large sums of money that require a great deal of time, by collecting the banknote to be dispensed without using the outlet for all the time necessary for preparing the emission.

The use of the additional magazine is also intended for cases of dispensing that, being of large amounts, are subject to delays in authorization for security reasons. The device will have a capacity that is not equal to the sum of the physical capacity of all the rollers, but equal to that of all rollers less one in such a way as always to be able to convey all the contents of a roller to the remaining rollers.

In non-operating status, a function can be provided that is aimed at updating the availability of banknotes in the various rollers by means of transfers from a roller to another in order to obtain the optimal position in function of the possible future dispensing requests.

At this point it is clear how the objects of the present invention have been achieved.

In particular, a banknote storage and dispensing device is provided that is provided with a limited number of magazines compared with the machines of the known technique. Owing to this solution, it was possible to reduce the cost of producing the device, limiting the costs of the mechanical parts of the machine.

Further, the encumbrance of the device was reduced considerably by moving from the usual seven magazines (one for each banknote denomination) to a smaller number of magazines as proposed according to the invention.

The innovative device disclosed above also enables satisfactory performance to be obtained in the different operating steps of the machine. In fact, during depositing, speed is comparable to that of prior-art devices. During the secondthoughts operation (i.e. when the immediate dispensing of a wad that has just be deposited is requested), the speed of performance of the operation is the same as for known devices. Also during the dispensing step, the machine has shown itself to be sufficiently fast, especially when small operations have to be performed.

Naturally, the description given above of an embodiment applying the innovative principles of the present invention is given by way of example of the innovative principles and must not therefore be construed as limiting the protective scope of what is claimed herein.

The invention claimed is:

1. An automatic device for storing and dispensing banknotes of a preset number of banknote denominations, said automatic device comprising an inlet for the banknotes, recognition means for recognizing the denomination of the incoming banknotes, a plurality of LIFO roller magazines for storing the banknotes, an outlet for the banknotes, conveying means for conveying the banknotes between the inlet, the roller magazines and the outlet, control means suitable for controlling the conveying means for transferring the banknotes from the inlet to the roller magazines during the depositing step and transferring the banknotes from the roller magazines to the outlet during the dispensing step, the roller magazines being smaller in number than said preset number of banknote denominations, the control means including means for memorizing a sequence of denominations stored in each roller magazine and means for controlling the conveying means to transfer the banknotes from one roller magazine to at least one other of the roller magazines according to the memorized sequences and a dispensing request entered in the device to enable the banknotes to be dispensed from the roller magazines to the outlet according to the dispensing request, the device having a banknote capacity equal to a banknote capacity of all roller magazines combined less a banknote capacity of one roller magazine.

2. The automatic device according to claim 1, wherein the conveying means includes belts, pulleys and banknote diverters.

3. The automatic device according to claim 1, wherein the preset number of denominations is seven.

4. The automatic device according to claim 1, wherein the number of magazines is from two to five.

5. The automatic device according to claim 1, wherein the route from the inlet to the roller magazines is controlled by the control means by an algorithm that determines a destination of a banknote according to the denomination thereof and of the memorized sequences of denominations stored in the roller magazines.

6. A method for storing and dispensing banknotes of a preset number of denominations using a device having an inlet for the banknotes, recognition means for recognizing the denomination of the incoming banknotes, a plurality of LIFO roller magazines for storing the banknotes, an outlet for the banknotes, conveying means for conveying the banknotes between the inlet, the roller magazines and the outlet, control means suitable for controlling said conveying means, the roller magazines being smaller in number than the preset number of banknote denominations and the control means comprising means for memorizing the sequence of denominations stored in each roller magazine, the method comprising for storage the steps of:

recognizing the denomination of each incoming banknote using the recognition means, determining the roller magazine intended for the incoming banknote according to the sequences of denominations memorized by the control means, and updating the datum on the sequence of denomination of the roller magazine selected as the destination of the incoming banknote and storing the banknote in said roller magazine, and for dispensing the steps of:

receiving from a user terminal a request to dispense banknotes, calculating, whether the requested banknotes are not available at the outlet of the roller magazines, transfers of banknotes between the roller magazines to free at each transfer one or more banknotes to be dispensed according to the memorized sequences of denominations stored in the roller magazines and of the dispensing request, and performing calculated transfers by dispensing after each transfer one or several banknotes from the roller magazines to the outlet and updating at each dispensing the data on the sequences of denominations stored in the roller magazines, wherein the device has a banknote capacity equal to a banknote capacity of all roller magazines combined less a banknote capacity of one roller magazine.

7. The method according to claim 6, wherein the control means determines the roller magazine for receiving an incoming banknote also according to the denomination thereof.

8. The method according to claim 6, wherein in a non-operational condition the step is provided of transferring banknotes from a roller magazine to another roller magazine according to possible future dispensing in such a way as to optimize the dispensing time thereof.

* * * * *

UNITED STATES PATENT AND TRADEMARK OFFICE

CERTIFICATE OF CORRECTION

PATENT NO. : 8,418,857 B2
APPLICATION NO. : 12/224338
DATED : April 16, 2013
INVENTOR(S) : Razzaboni et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 736 days.

Signed and Sealed this
First Day of September, 2015

Michelle K. Lee

Michelle K. Lee
*Director of the United States Patent and Trademark Office*